US007121104B2

(12) United States Patent
Howington et al.

(10) Patent No.: US 7,121,104 B2
(45) Date of Patent: Oct. 17, 2006

(54) ADJUSTABLE SHELF SYSTEM FOR REFRIGERATED CASE

(75) Inventors: Larry C. Howington, Chesterfield, VA (US); Steven O. Stubblefield, Mechanicsville, VA (US)

(73) Assignee: Delaware Capital Formation, Inc., Wilmington, DE (US)

( * ) Notice: Subject to any disclaimer, the term of this patent is extended or adjusted under 35 U.S.C. 154(b) by 98 days.

(21) Appl. No.: 10/947,959

(22) Filed: Sep. 23, 2004

(65) Prior Publication Data

US 2006/0059934 A1 Mar. 23, 2006

(51) Int. Cl.
*A47F 3/04* (2006.01)

(52) U.S. Cl. ..... 62/256; 248/242; 312/116

(58) Field of Classification Search ..... 62/249, 62/251, 256; 108/6, 106–108; 211/90.02, 211/187, 190, 193, 207; 248/241–243; 312/116, 312/408, 351

See application file for complete search history.

(56) References Cited

U.S. PATENT DOCUMENTS 3,256,709 A * 6/1966 Stepleton ..... 62/256
3,368,784 A 2/1968 Peterson
3,463,433 A 8/1969 Stein et al.
3,550,890 A 12/1970 Kemp
3,602,472 A 8/1971 Smyth-Tyrrell
3,729,161 A 4/1973 Christensen
3,973,033 A 8/1976 Szarvasi
4,008,873 A 2/1977 Travaglio et al.
4,108,085 A 8/1978 Shepherd et al.
4,135,369 A * 1/1979 Allgeyer et al. ..... 62/251
4,307,671 A 12/1981 Albano
4,378,925 A 4/1983 Griffin
4,421,289 A 12/1983 Sturm
4,492,169 A * 1/1985 Ware et al. ..... 108/6
4,552,272 A * 11/1985 Field ..... 211/88.01
4,633,677 A 1/1987 Maehara
4,934,645 A 6/1990 Breslow
4,938,034 A 7/1990 Rosanio et al.
5,037,054 A 8/1991 McConnell
5,154,388 A 10/1992 Magaro
5,199,579 A 4/1993 Van Duyne
5,205,421 A * 4/1993 Bustos ..... 211/59.2
5,228,581 A 7/1993 Palladino et al.
5,357,767 A 10/1994 Roberts
5,452,875 A 9/1995 Kern
5,502,979 A 4/1996 Renard
5,508,898 A 4/1996 McGovern
5,531,159 A 7/1996 Stubblefield
5,645,182 A 7/1997 Miller, Jr. et al.
5,738,019 A 4/1998 Parker (Continued)

*Primary Examiner*—William E. Tapolcai
(74) *Attorney, Agent, or Firm*—Foley & Lardner LLP

(57) ABSTRACT

An adjustable shelving system is disclosed for an open-front refrigerated display case having an air-curtain at least partially across a front of the display case and having a shelf configured to hold products to be displayed. A first bracket and a second bracket are coupled to an interior panel of the display case where each bracket includes a first travel stop and a spaced-apart second travel stop. The shelf has pin members that interface with the brackets and engage the travel stops. The pin members engage the first travel stop to retain the shelf in a first position and engage the second travel stop to retain the shelf in a second position having an angle of inclination relative to the first position. A distance from a front edge of the shelf and the air curtain is substantially constant between the first position and the second position.

35 Claims, 8 Drawing Sheets

U.S. PATENT DOCUMENTS

| | | | |
|---|---|---|---|
| 5,755,108 | A | 5/1998 | Ibrahim et al. |
| 5,911,744 | A | 6/1999 | Kawaguchi |
| 6,220,461 | B1 | 4/2001 | Dickinson |
| 6,379,240 | B1 | 4/2002 | Livchak et al. |
| 6,389,993 | B1 | 5/2002 | Ondrasik |
| 6,490,983 | B1 | 12/2002 | Nicholson et al. |
| 6,519,962 | B1 | 2/2003 | Schuetter |
| 6,539,741 | B1 | 4/2003 | Navarro |
| 6,619,052 | B1 | 9/2003 | Nash, Jr. |
| 6,641,098 | B1 | 11/2003 | Proffitt |
| 6,701,735 | B1 | 3/2004 | Daddis, Jr. et al. |
| 6,722,149 | B1 | 4/2004 | Saroka et al. |

* cited by examiner

ADJUSTABLE SHELF SYSTEM FOR REFRIGERATED CASE

BACKGROUND

The present invention relates to an adjustable shelf system. The present invention more specifically relates to an adjustable shelf for use in a refrigerated case for storing and displaying objects such as food products.

It is known to provide for a refrigerated case for storage and presentation of food products (such as meat, etc.). Such known refrigerated cases may include those of a type typically having an open front to permit consumers to reach in and select products from shelves within the case (e.g. "self service" type cases, etc.). Open-front refrigerated cases often have an "air curtain" extending across the front of the case and is made of one or more layers of refrigerated air that flow downwardly from a discharge along a top front portion of the case and is drawn into a return along a lower front portion of the case. The air curtain is intended to minimize "mixing" of surrounding ambient-temperature air with the chilled air within the case and behind the air-curtain.

Such cases often have shelves that are fixed in a generally horizontal orientation. Such cases may also have shelves that are configured to be adjustable between a horizontal and a "sloped" or "inclined" orientation. However, such known adjustable shelves have certain disadvantages. For example, typical horizontal shelves in an open-front refrigerated case often have a front end that is positioned in close proximity to the air curtain. However, such known adjustable shelves typically pivot about a connection point at the rear of the case so that the front end of the shelf rotates inwardly and away from the air curtain as the angle of inclination of the shelf is increased. As the front end of the shelf moves inwardly and away from the air curtain, the air curtain tends to degrade and to draw more external ambient air into the case and tending to decrease performance of the case and to increase product temperatures and energy consumption by the case.

It would be desirable to provide an adjustable shelf for a refrigerated case or the like of a type disclosed in the present Application that includes any one or more of these or other advantageous features:

(1) An adjustable shelf capable of adjustment between a generally horizontal position and a sloped position having an angle of inclination.

(2) An adjustable shelf capable of movement between an angle of inclination of 0 degrees and approximately 30 degrees or more.

(3) An adjustable shelf that is configured to be fixed at one or more angles of inclination.

(4) An adjustable shelf having an adjustment device configured to maintain a front end of the shelf at a generally constant distance from an air curtain as the shelf is adjusted to a variety of angles of inclination.

(5) An adjustable shelf that having an adjustment device that is configured to be quickly and easily adjusted.

(6) An adjustable shelf that maintains a constant area for product presentation at any one of a variety of angles of inclination.

(7) An adjustable shelf that is adapted for use with a case designed for stocking from the front (i.e. front-loading) or from the rear of the case (i.e. rear-loading).

SUMMARY

The present invention relates to a refrigerated case of a type having an open front and an air curtain circulating across the open front. At least one shelf member is configured for adjustment between a first position and a second position. An adjustment device is coupled to an interior of the case and configured to engage the shelf member so that a distance between a front end of the shelf member and the air curtain remains substantially constant between the first position and the second position.

The present invention also relates to a adjustable shelving system for an open-front refrigerated display case of a type having an air-curtain at least partially across a front of the display case and shelves within the display case configured to hold products to be displayed. A first bracket and a second bracket are coupled to an interior panel of the display case. Each bracket includes at least a first travel stop and a spaced-apart second travel stop. The shelves have pin members configured to interface with the brackets and to selectively engage the travel stops. The pin members are configured to engage the first travel stop for retaining at least one of the shelves in a first position and to engage the second travel stop for retaining at least one of the shelves in a second position having an angle of inclination relative to the first position so that a distance from a front edge of the at least one of the shelves and the air curtain is substantially constant between the first position and the second position.

The present invention also relates to a adjustable shelf apparatus for a refrigerated display case. The apparatus includes a first stationary portion and a second stationary portion configured for attachment to an rear panel of the display case at a substantially common elevation. At least one channel is formed in the first stationary portion and the second stationary portion. A movable portion having a generally planar shelf surface is configured for storage of the products thereon. At least one projection extends from opposite sides of the movable portion and is configured to engage the channel on the stationary portions for adjustably supporting the movable portion relative to the stationary portion, so that the shelf surface moves away from the rear panel of the display case as an angle of inclination of the shelf surface is increased and the shelf surface moves toward the rear panel of the display case an the angle of inclination of the shelf surface is decreased.

The present invention also relates to a case having a cabinet with an open front portion for storage of products therein. At least one adjustable shelf member is mounted within the interior portion of the cabinet for storage of the products thereon. The adjustable shelf member includes at least one bracket for attachment to the interior portion and a platform portion movably is coupled to the bracket for movement between a horizontal position and one or more tilted positions. As the platform rotates between the horizontal position and the tilted positions, the platform translates fore and aft so that a distance between a front end of the platform and a rear portion of the cabinet remains substantially constant.

DETAILED DESCRIPTION

Figure 1A:
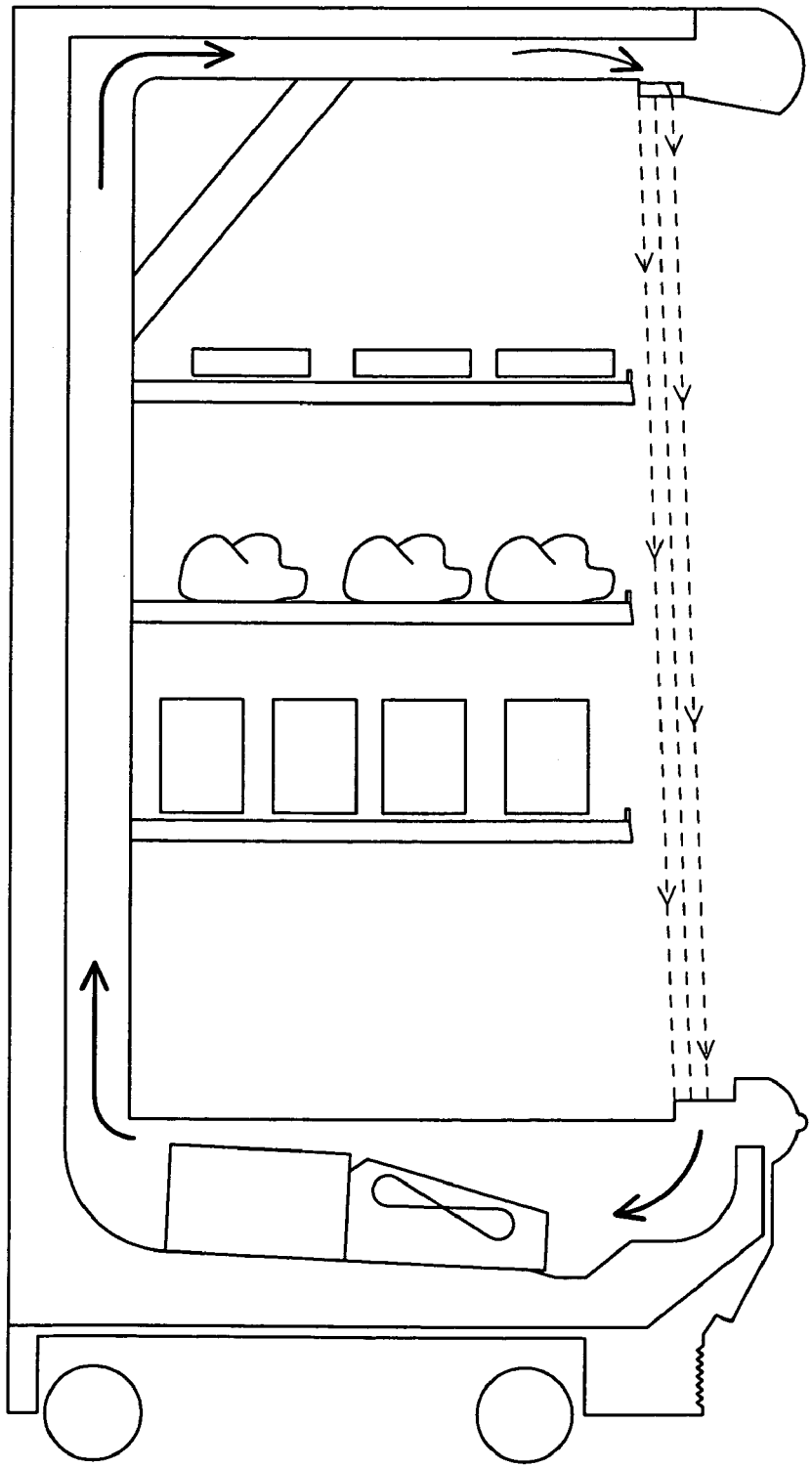
FIGURE 1A PRIOR ART
FIG. 1A is a schematic representation of a side elevation view of a prior art adjustable shelf for a refrigerated case in one position.
Figure 1B:
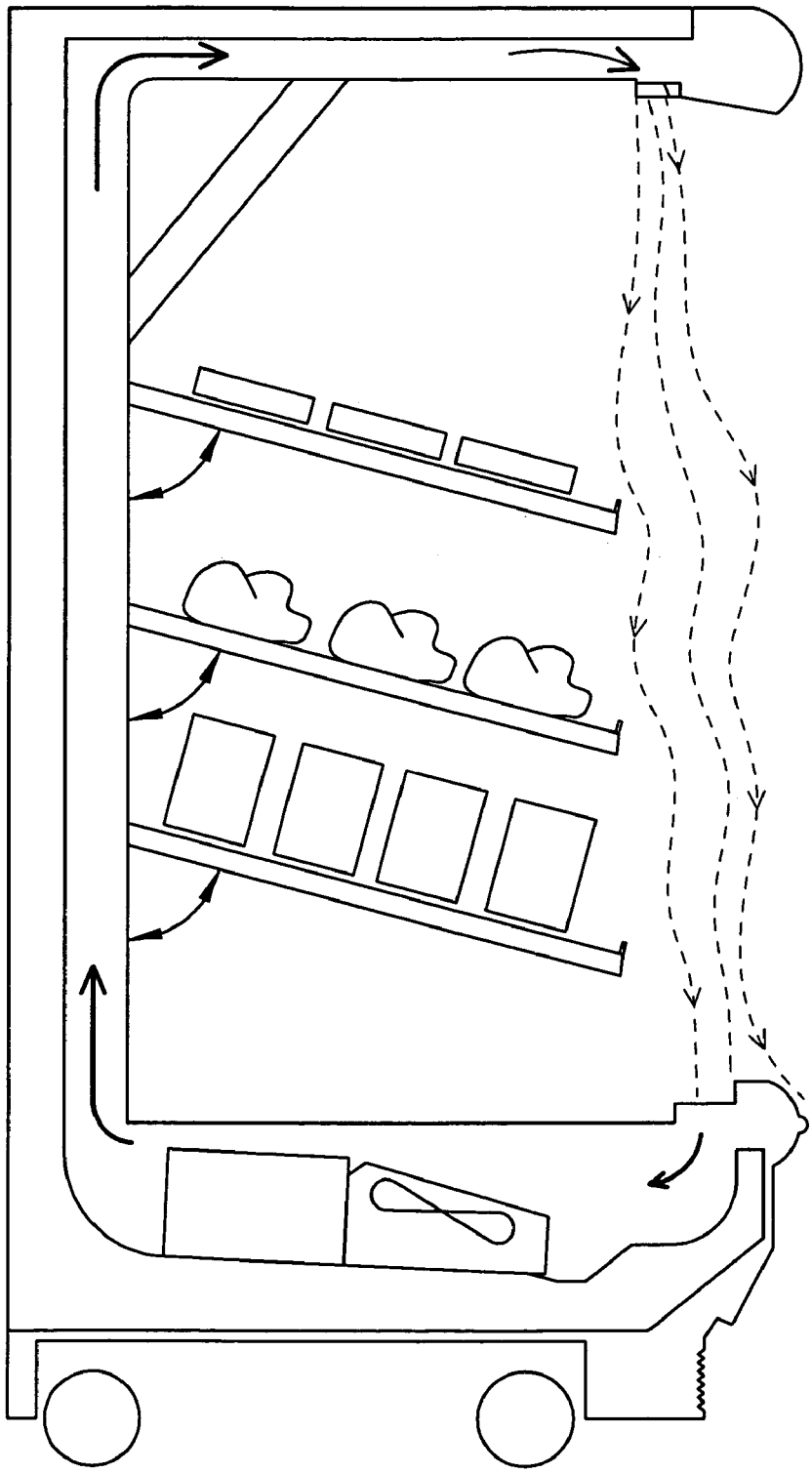
FIGURE 1B PRIOR ART
FIG. 1B is a schematic representation of a side elevation view of the prior art adjustable shelf for a refrigerated case of FIG. 1A in another position.

Referring to FIGS. 1A–1B, a typical prior art front-loading refrigerated case of the open-front type with an air curtain (e.g. air stream, etc.) and adjustable shelves is shown. The shelves are generally configured to pivot about a rear end of the shelf (e.g. at a location where the rear end of the shelf attaches to a panel within the case, etc.). Angular adjustment of such prior art shelves (shown schematically as adjusted from a horizontal position to an inclined position) often results in the front end of the shelf being drawn rearwardly (e.g. pulled-back, drawn back, retracted, etc.) into the case and away from the air curtain. The distance between the front edge of the shelf and the air curtain tends to increase as an angle of inclination of the shelf increases from 0 degrees. The increase in distance between the front edge of the shelf and the air curtain is believed to degrade (e.g. disrupt, disturb, etc.) the function and/or performance of the air curtain in providing a boundary to separate an interior refrigerated portion of the case from an external ambient environment surrounding the case (e.g. supermarket atmosphere, etc.).

Referring to FIGS. 2–5C, the basic elements and assemblies of an adjustable shelf system 10 for a refrigerated case 12 are shown according to one embodiment for a refrigerated case of the front-loading, open-front type (e.g. "reach-in," "self-service," etc.) having an "air curtain" 14 (e.g. "air stream" etc.) with one or more layers of air for maintaining the temperature of refrigerated products 20 (e.g. meat, fish, dairy, deli, produce, etc.). The air curtain 14 is shown flowing downwardly over the open front 16 of the case and is intended to enhance the performance of the refrigerated case 12 by providing a boundary or separation between the refrigerated interior of the case 12 and the warmer ambient environment external to the case.

However, the adjustable shelf system is suitable for use with any type of refrigerated display case. For example, according to another embodiment, the adjustable shelf system is adapted for use with a rear-loading, open-front type case, where a rear portion of the case is at least partially "open" or "exposed" to a refrigerated enclosure (e.g. walk-in cooler, cold-room, cooler box, etc.) so that the case may be restocked from a rear portion by a person within the refrigerated enclosure by reaching through the open rear of the case for placement of products on the shelves. Use of the shelf system with a rear-loading case is intended to further minimize disturbance or disruption of the air curtain and further avoids inconvenience to consumers accessing products from the front of the case. According to other embodiments, the adjustable shelf system may be used with other type of cases such as service cases, closed-front cases, etc.

According to further embodiments, the shelf may be used with non-refrigerated cases such as produce type cases for display of produce and the like. For produce type cases, the shelf may also include misting devices or sprayers integrated into an underside of the shelf for misting of produce stored beneath the shelf (not shown).

The adjustable shelf system 10 is shown to include a "movable" shelf section 30 (e.g. shelf, platform, etc.) and a "stationary" bracket section 50 (e.g. bracket, holder, support, adjustment device, etc.). The shelf 30 and the bracket 50 are configured to interface in a manner that permits the shelf 30 to rotate between a first position (e.g. "horizontal" as shown to be zero degrees) and a variety of second positions (e.g. angled, tilted, inclined, sloped, etc.) that may generally include an angle of inclination $\alpha$ of up to about 35 degrees. The shelf 30 and the bracket 50 also interact to permit the shelf 30 to translate forwardly and rearwardly (e.g. reciprocate, move fore and aft, move backward and forward, etc.) relative to a front 16 and a rear 18 of the case 12 so that a distance between a front edge 32 of the shelf 30 and the air curtain 14 remains generally constant as the position of the shelf 30 is rotatably adjusted between various angles of inclination $\alpha$ (e.g. from horizontal to various inclined positions, etc.).

Note that the adjustable shelf system is also suitable for use with any type of refrigerated case intended for use in displaying objects such as food products in facilities (such as supermarkets, hypermarkets, convenience stores, delis, etc.) so that disruption or degradation of an air curtain or the like is minimized with the shelf positioned at any one of a variety of angles of inclination. Further, according to other alternative embodiments, the shelf system may be configured for use within any desired angle of inclination.

Figure 3A:
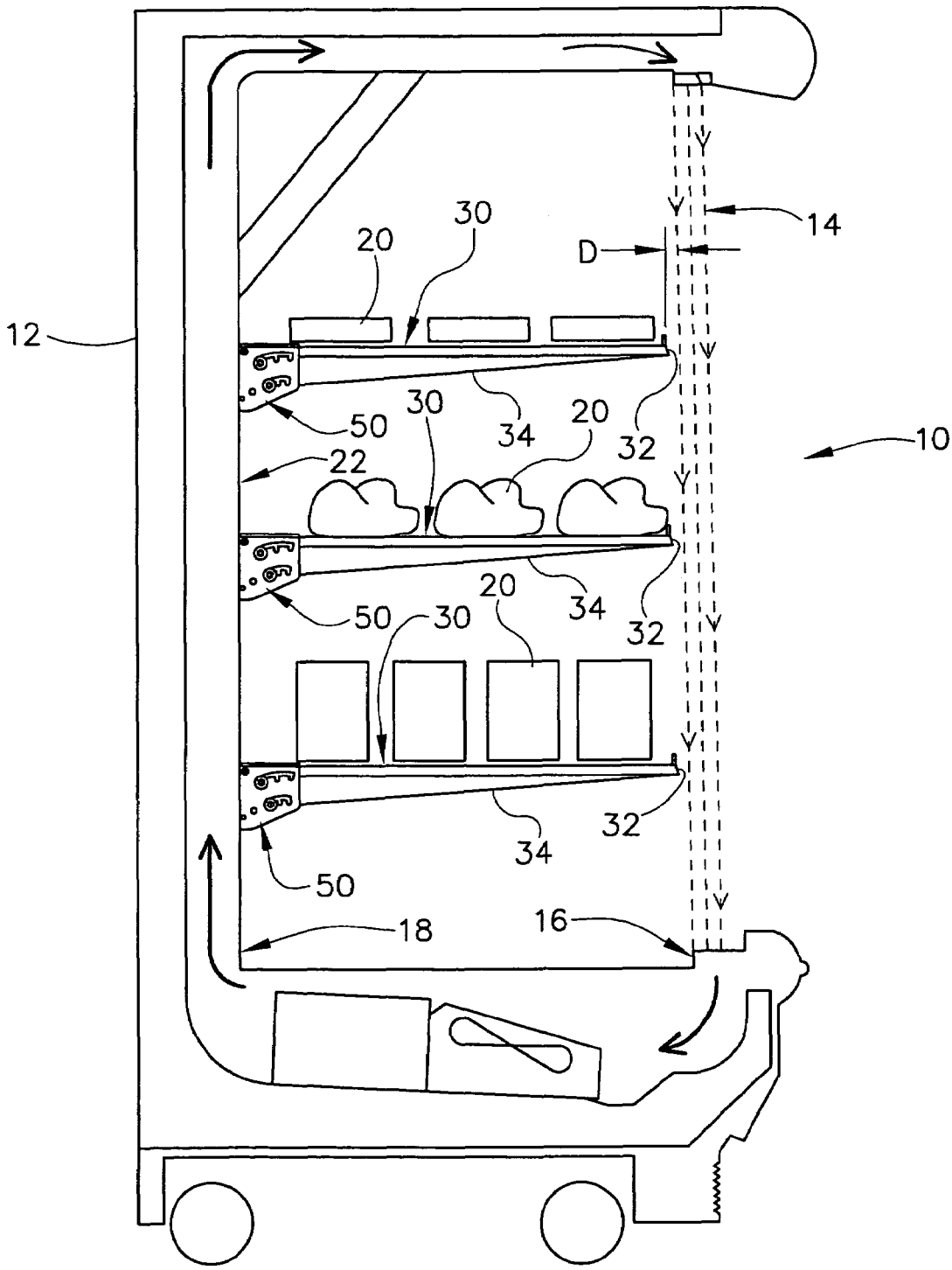
FIG. 3A is a schematic representation of a side elevation view of an adjustable shelf system for a refrigerated case in a first position according to the embodiment of FIG. 2.
Figure 3B:
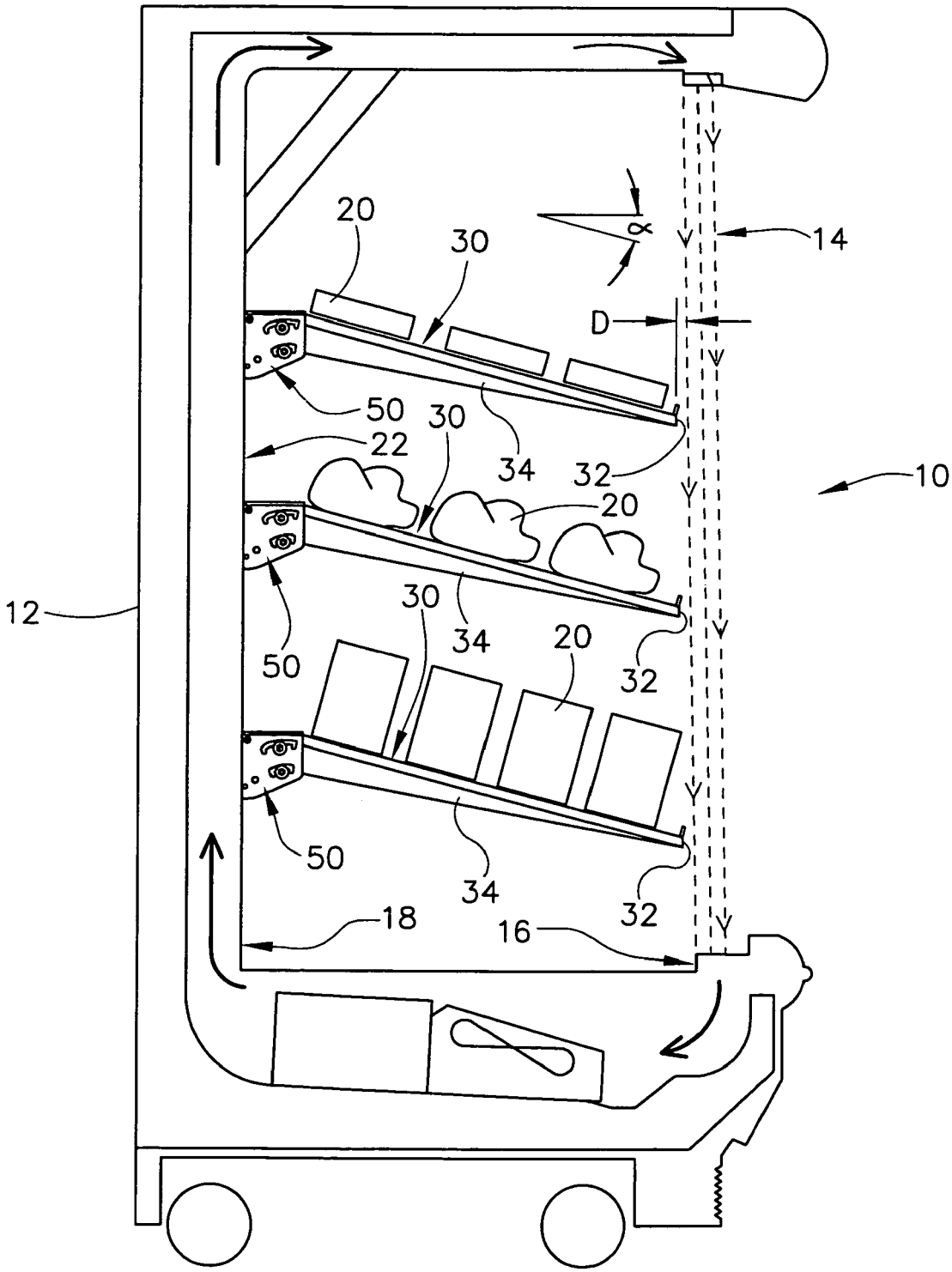
FIG. 3B is a schematic representation of a side elevation view of the adjustable shelf system for a refrigerated case shown in the embodiment of FIG. 2 in another position.
Figure 3C:
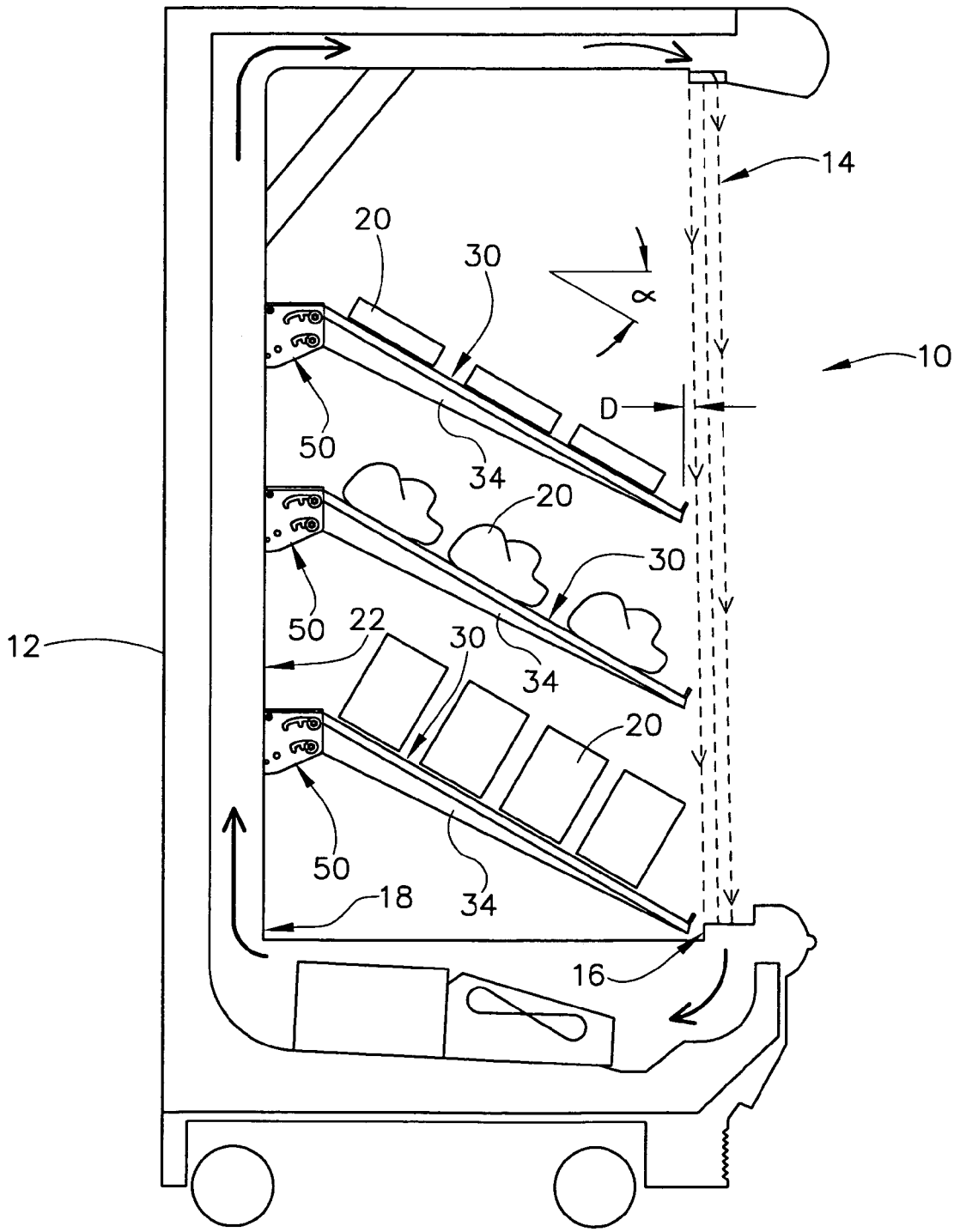
FIG. 3C is a schematic representation of a side elevation view of the adjustable shelf system for a refrigerated case shown in the embodiment of FIG. 2 in a further position.

Referring to FIGS. 3A–3C, an open-front refrigerated case 12 with an air curtain 14 is shown having an adjustable shelf system 10 according to one embodiment. The adjustable shelf system includes at least one movable shelf 30 (shown schematically as three shelves—where one or more of the shelves may be adjustable). The range of adjustment of the shelves 30 is shown for example with the shelves 30 in a first position (shown as substantially horizontal or having an angle of inclination of approximately 0 degrees in FIG. 3A), and a second position (shown as sloped at an angle of inclination $\alpha$ of approximately 17 degrees in FIG. 3B), and a third position (shown as sloped at an angle of inclination $\alpha$ of approximately 30 degrees in FIG. 3C). The shelves may be configured for positioning at any suitable angle for supporting and displaying refrigerated products within the case. According to a preferred embodiment, the range of adjustment of the angle of inclination $\alpha$ of the shelf 30 is between approximately 0 degrees and 35 degrees.

Referring further to FIG. 3A, when the angle of inclination $\alpha$ of the shelf 30 is 0 degrees (i.e. horizontal) a front edge 32 (e.g. end, tip, etc.) of the shelf is positioned a distance D from an inside surface of the air curtain 14. According to one embodiment, the depth of the shelf is approximately 18 inches and the distance D is within a range of approximately 2 inches to 6 inches and more particularly within a range of approximately 3¾ inches to 4 inches, however, any suitable distance may be used that is intended maintain or improve performance of the air curtain. Referring further to FIGS. 3B–3C, as the angle of inclination α of the shelf 30 changes from 0 degrees to a sloped position by rotational motion of the shelf 30, the shelf 30 is also configured for translational motion so that the distance D between the front edge 32 of the shelf 30 and the air curtain 14 remains generally constant. The position of the front edge 32 of the shelf 30 may also be referenced from an interior back panel 22 of the display case 12.

Figure 4:
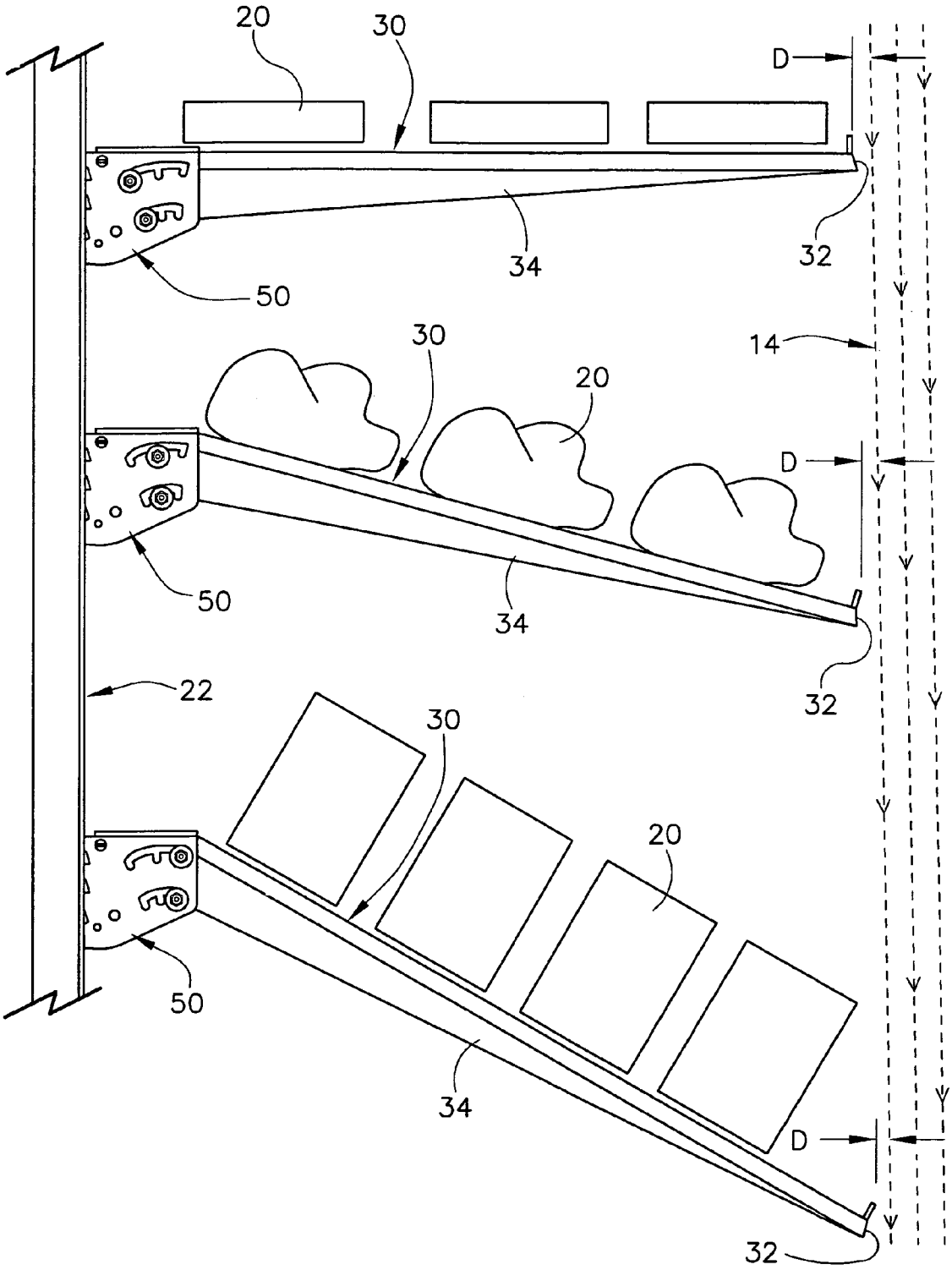
FIG. 4 is a schematic representation of a side elevation view of an adjustable shelf system for a refrigerated case according to an embodiment.
Figure 5A:
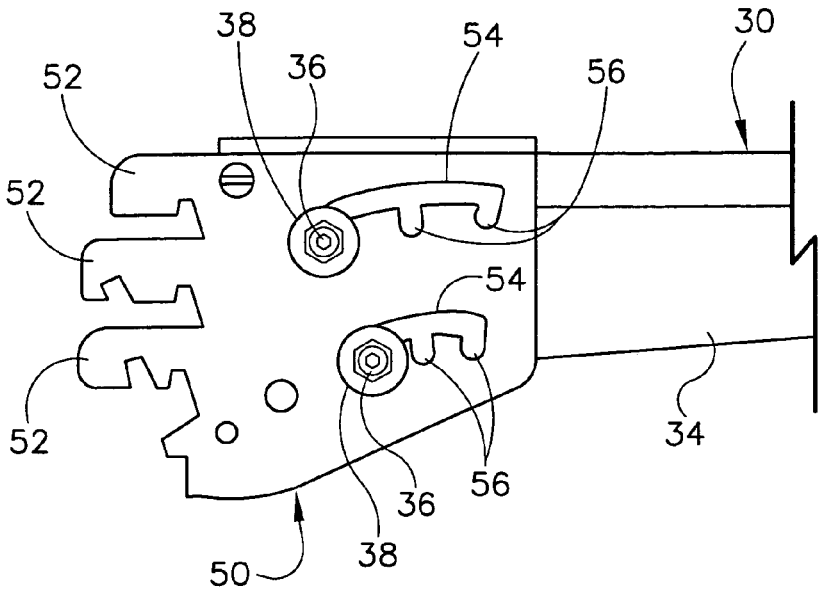
FIG. 5A is a schematic representation of a side elevation view of a portion of the adjustable shelf system according to the embodiment of FIG. 3A.
Figure 5B:
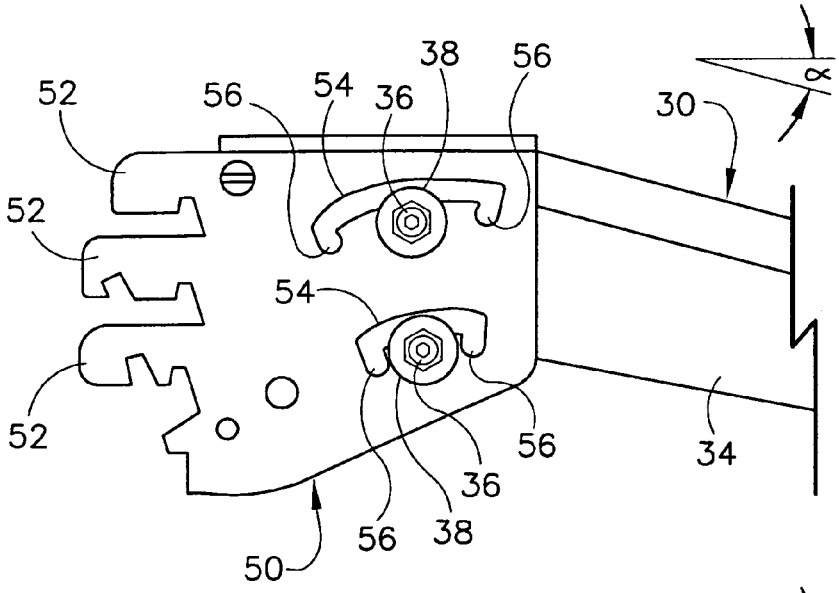
FIG. 5B is a schematic representation of a portion of a side elevation view of the adjustable shelf system according to the embodiment of FIG. 3B.
Figure 5C:
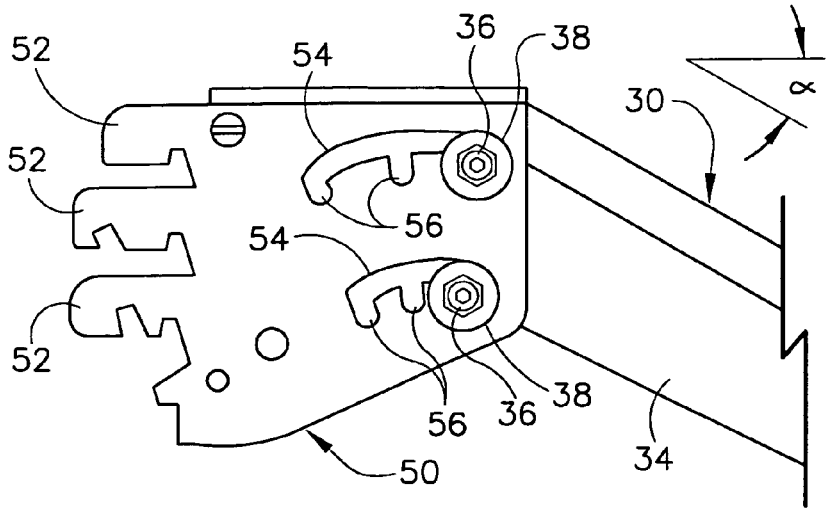
FIG. 5C is a schematic representation of a portion of a side elevation view of the adjustable shelf system according to the embodiment of FIG. 3C.

Referring to FIGS. 4–5C, the shelf and the bracket of one side (e.g. a "near" side) of the adjustable shelf system 10 are shown according to an embodiment. The opposite side (e.g. "far" side) of the shelf 30 is provided with a similar construction and features so that the shelf 30 is supported at opposite sides. The bracket 50 may be formed from sheet metal in a stamping process or the like. The bracket 50 is shown having a series of hooks 52 (e.g. fingers, grips, holders, etc.) configured to engage corresponding openings 24 along an interior panel (shown as a back panel 22 in FIGS. 2–3C) within the refrigerated case 12 so that the brackets 50 are removable from the panel 22 and may be positioned at any desired height on the panel. Bracket 50 is also shown to include two channels 54 (e.g. slots, tracks, paths, etc.) that are configured in a generally arcuate or curvilinear manner. The channels 54 also are shown to include travel stops 56 (e.g. recesses, dog-legs, catches, detents, etc.) corresponding to desired positions for angular inclination of the shelf 30. According to an alternative embodiment where the case is a rear-loading type case, the brackets may be coupled to a mounting strip or the like attached to or formed with a frame member at the rear of the case.

Shelf 30 includes support members 34 shown coupled along an underside of the shelf 30 near opposite sides of the shelf. Support members 34 are shown as generally triangular shaped members and may be integrally formed with the shelf 30, or attached to the shelf 30 using suitable assembly techniques (e.g. solder, brazing, interference fit, tab and slot connectors, rivets or the like). Projections 36 (e.g. posts, pins, bolts, runners, etc.) are shown extending outwardly from the support members 34 and are configured to engage channels 54 when the shelf 30 is coupled to the bracket(s) 50. Projections 36 may also include retainers 38 configured to retain the projection 36 within the channel 54 after the adjustable shelf system 10 has been assembled. According to a preferred embodiment, the projection 36 is a ¼ inch diameter threaded bolt and the retainer 38 is a locking nut and a flat washer. The projections 36 on the shelf support member 34 are configured to travel within the channels 54 of the bracket 50. The spacing and curvature of the channels 54 is configured to impart a rotational and translational movement on the shelf 30 as the projections 36 on the shelf support member 34 travel within the channels 56. The travel stops 56 (shown as thee travel stops in FIGS. 5A–5C, but may be any suitable number) are located so that the projections 36 "drop-down" or become "seated" within the recesses to position and support the shelf 30 at any one of a variety of predetermined angles of inclination α (shown for example as 0 degrees, and 17 degrees and 30 degrees in FIG. 4). According to alternative embodiments, the shelf support member may have any suitable shape or may be integrally formed with the shelf. According to other alternative embodiments, the projection may be any suitable member such as a pin, lug, tab, etc. Further, the relationship of the projections and the channels may be reversed so that the projection is provided on the bracket and the channels are provided on the shelf.

According to another alternative embodiment, the brackets may include separate pockets (e.g. cups, U-shaped holders, etc.—not shown) located along an arcuate path so that the projections from the shelf support member may be placed in a particular set of pockets (e.g. "seated", etc.) corresponding to a desired angle of inclination of the shelf (e.g. 0, 17 or 30 degrees or the like). According to another alternative embodiment, the channels may comprise grooves (not shown) formed in the brackets and the projections may be spring-biased pins configured to travel along the grooves as the angle of inclination of the shelf is adjusted.

Figure 2:
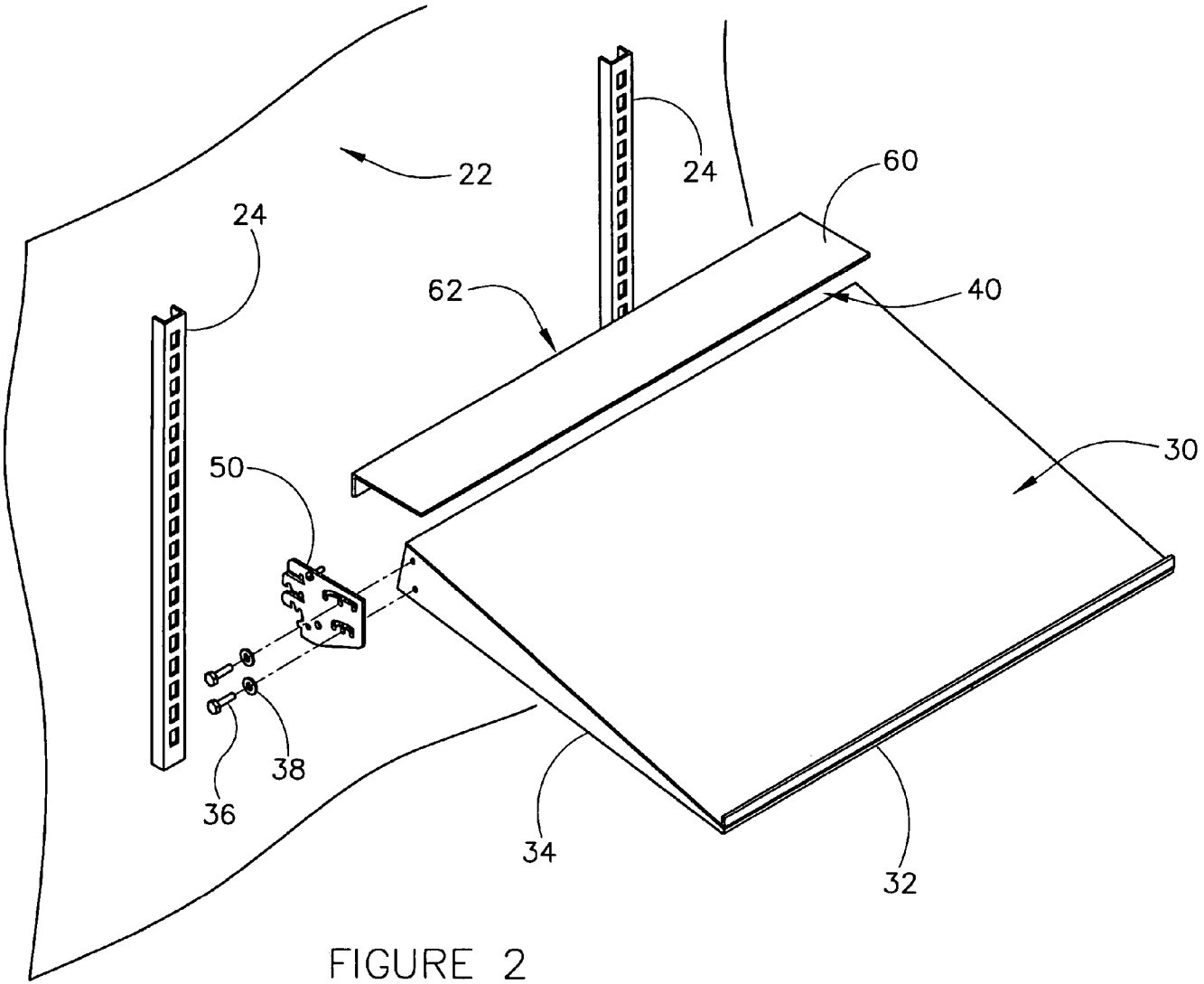
FIG. 2 is a schematic representation of an exploded perspective view of an adjustable shelf system for a refrigerated case according to one embodiment.

Referring to FIG. 2, a cover panel 60 for the adjustable shelf system 10 is shown according to an embodiment. The cover panel 60 is intended to cover any opening or gap between a rear edge 40 of the shelf and the rear panel 22 of the case 12 when the shelf 30 is translated forward and rotated to an angle of inclination α. The cover panel 60 is shown as a relatively thin sheet of material (e.g. steel, sheet metal, etc.) positioned above and attached to the brackets 50. The cover panel 60 may be attached to the brackets 50 by any suitable connection, such as tab-and-slot, interference fit, fasteners, etc. Cover panel 60 is shown with a rear edge 62 configured to abut the rear interior panel 22 of the case 12. Cover panel 60 is also shown having a front edge 64 spaced sufficiently forward to overlap a rear edge 40 of the shelf 30 and cover any opening or gap between the rear edge 40 of the shelf 30 and the rear panel 22 of the case 12 when the shelf 30 is translated forward and rotated to an angle of inclination α.

According to any preferred embodiment, the adjustable shelf system provides one or more shelf members that may be adjusted in a rotational and translational manner from a horizontal position to a position having any suitable angle of inclination for a desirable display of products within the case, and so that a distance between the front edge of the shelf member and an air curtain extending across an open front of the case remains generally constant. The adjustable shelf system is configured for use with a wide variety of refrigerated case type, such as front-loading and rear-loading display cases having an open-front with an air curtain, closed front cases, service-type cases, etc.

It is also important to note that the construction and arrangement of the elements of the adjustable shelf as shown in the preferred and other exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the operation of the interfaces between the brackets and the shelf may be reversed or otherwise varied, the length or width of the structures and/or members or connectors or other elements of the system may be varied, the angle of inclination of the adjustable shelf may be varied (e.g. upward or downward), side-to-side, etc.) to suit any desired application. It should be noted that the elements and/or assemblies of the adjustable shelf may be constructed from any of a wide variety of materials that provide sufficient strength or durability, in any of a wide variety of colors, textures and combinations. It should also be noted that the adjustable shelf may be used in association with other refrigeration devices, or any of a wide variety of other equipment in any of a wide variety of other applications. For example, the shelves may include additional features such as lighting devices for illuminating the products, misting devices or sprayers for maintaining a desired moisture level of the products, brackets for displaying information relating to the products, etc. Accordingly, all such modifications are intended to be included within the scope of the present inventions. Other substitutions, modifications, changes and omissions may be made in the design, operating conditions and arrangement of the preferred and other exemplary embodiments without departing from the spirit of the present inventions.

The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating configuration and arrangement of the preferred and other exemplary embodiments without departing from the spirit of the present inventions as expressed in the appended claims.

What is claimed is:

1. A refrigerated case of a type having an open front and an air curtain circulating substantially across the open front, the improvement comprising:

at least one shelf member configured for adjustment between a first position and a second position;

an adjustment device coupled to an interior of the case and configured to engage the shelf member, the adjustment device comprising at least one bracket;

a track included on at least one of the bracket and the shelf member, the track comprising a first travel stop corresponding to the first position and a second travel stop corresponding to the second position and slidably interfacing with the other of the bracket and the shelf member, so that a distance between a front end of the shelf member and the air curtain remains substantially constant between the first position and the second position.

2. The refrigerated case of claim 1 wherein the first position is a substantially horizontal position.

3. The refrigerated case of claim 1 wherein the second position is an angle of inclination.

4. The refrigerated case of claim 3 wherein the angle of inclination is within a range of approximately 0 degrees to 35 degrees.

5. The refrigerated case of claim 1 wherein the distance is within a range of approximately 2 inches to 6 inches.

6. The refrigerated case of claim 1 wherein the shelf member comprises at least one projection disposed on opposite sides of the shelf member proximate a back end of the shelf member.

7. The refrigerated case of claim 6 wherein the adjustment device comprises a pair of brackets each having at least one arcuate track configured to receive the projection.

8. The refrigerated case of claim 7 wherein the first travel stop includes a first leg configured to receive the projection when the shelf member is in the first position.

9. The refrigerated case of claim 8 wherein the second travel stop includes a second leg configured to receive the projection when the shelf member is in the second position.

10. The refrigerated case of claim 1 wherein the case is a rear-loading case.

11. An adjustable shelving system for an open-front refrigerated display case of a type having an air-curtain disposed at least partially across a front of the display case and having a plurality of shelves within the display case configured to hold products to be displayed, the improvement comprising:

a first bracket and a second bracket coupled to an interior panel of the display case;

each bracket comprising at least a first travel stop and a spaced-apart second travel stop;

the shelves having pin members configured to interface with the brackets and to selectively engage the travel stops;

the pin members configured to engage the first travel stop for retaining at least one of the shelves in a first position and to engage the second travel stop for retaining at least one of the shelves in a second position having an angle of inclination relative to the first position;

wherein a distance from a front edge of the at least one of the shelves and the air curtain is substantially constant between the first position and the second position.

12. The system of claim 11 wherein the brackets comprise slots and the travel stops comprise portions of the slots.

13. The system of claim 11 wherein the pin members are configured to move along a curvilinear path within the slots.

14. The system of claim 11 wherein the angle of inclination is approximately 17 degrees.

15. The system of claim 11 wherein the angle of inclination is approximately 30 degrees.

16. The system of claim 11 wherein the brackets are vertically adjustable relative to the interior panel of the display case.

17. The system of claim 11 wherein each of the plurality of shelves is configured for movement between the first position and the second position.

18. The system of claim 11 wherein a distance from the interior of the panel to the front edge of at least one of the shelves remains substantially constant between the first position and the second position.

19. The system of claim 11 further comprising a cover panel configured to substantially cover a rear edge of at least one of the shelves in the first position and the second position.

20. The system of claim 11 wherein the case has a rear portion that is at least partially open to permit restocking of the case from the rear of the case.

21. An adjustable shelf apparatus for a refrigerated display case, comprising:

a first stationary portion and a second stationary portion configured for attachment at a rear portion of the display case at a substantially common elevation;

at least one channel formed in the first stationary portion and the second stationary portion;

a movable portion having a generally planar shelf surface configured for storage of products thereon;

at least one projection extending from opposite sides of the movable portion and configured to engage the channel on the stationary portions for adjustably supporting the movable portion relative to the stationary portion;

a filler panel configured to substantially overlap a rear end of the shelf surface as the shelf surface moves away from the rear panel of the display case;

so that the shelf surface moves away from the rear portion of the display case as an angle of inclination of the shelf surface is increased and the shelf surface moves toward the rear portion of the display case an the angle of inclination of the shelf surface is decreased.

22. The apparatus of claim 21 wherein the channel comprises a slot having an arcuate portion.

23. The apparatus of claim 21 wherein the channel comprises recesses corresponding to at least a first position and a second position of the shelf surface.

24. The apparatus of claim 21 wherein the shelf surface is angularly adjustable within a range of approximately 0 degrees to 35 degrees.

25. The apparatus of claim 21 wherein the at least one channel comprises two slots having an arcuate portion.

26. The apparatus of claim 21 wherein the at least one projection comprises two posts extending from opposite sides of the movable portion and configured to engage the two slots.

27. The apparatus of claim 21 wherein the rear portion is at least partially open and configured to permit restocking of the shelves from the rear portion.

28. A case for display of food products, comprising:

a cabinet having a substantially open front portion for storage of products therein;

at least one adjustable shelf member mounted within the interior portion of the cabinet for storage of the products thereon;

the adjustable shelf member comprising at least one bracket for attachment to the interior portion and a platform portion movably coupled to the bracket for movement between a substantially horizontal position and one or more tilted positions;

a panel configured to interface with a rear end of the platform as the platform moves within the cabinet;

wherein as the platform rotates between the substantially horizontal position and the one or more tilted positions, the platform translates fore and aft so that a distance between a front end of the platform and a rear portion of the cabinet remains substantially constant.

29. The case of claim 28 wherein the one or more tilted positions comprise at least one of approximately 17 degrees and 30 degrees.

30. The case of claim 28 wherein the platform comprises at least one runner configured to engage at least one track on the bracket to permit rotational and translational movement of the platform.

31. The case of claim 28 wherein the distance between the front end of the platform and the air stream is within the range of approximately 2 inches to 6 inches.

32. The case of claim 28 wherein the bracket comprises at least one runner configured to engage at least one track coupled to the platform to permit rotational and translational movement of the platform.

33. The case of claim 28 further comprising an air curtain extending at least partially across the open front.

34. The case of claim 28 wherein the products comprise produce.

35. The case of claim 28 wherein the rear portion has an opening configured to permit the shelf member to be restocked from the rear portion of the case.

* * * * *